US005130069A

United States Patent [19]

Tietz et al.

[11] Patent Number: 5,130,069

[45] Date of Patent: Jul. 14, 1992

[54] PROCESS FOR PRODUCING DYEABLE HOT-BULKED POLYPROPYLENE FIBERS MODIFIED WITH A COPOLYAMIDE

[75] Inventors: Raymond F. Tietz, Wilmington; Wae-Hai Tung, Seaford, both of Del.

[73] Assignee: E. I. Du Pont de Nemours and Company, Wilmington, Del.

[21] Appl. No.: 560,298

[22] Filed: Jul. 27, 1990

[51] Int. Cl.[5] ..... D01F 8/00; D02J 1/02; D06P 1/00

[52] U.S. Cl. ..... 264/78; 264/103; 264/210.6; 264/210.8; 264/211; 264/211.15; 8/497; 8/149.2; 8/920; 57/350; 57/908

[58] Field of Search ..... 264/103, 210.8, 211, 264/78, 210.6, 211.15; 8/149.2, 497, 920; 57/350, 908

[56] References Cited

U.S. PATENT DOCUMENTS

| | | | |
|---|---|---|---|
| 3,186,155 | 6/1965 | Breen et al. | 57/140 |
| 3,328,484 | 6/1967 | Alliot-Lugaz et al. | 260/857 |
| 3,433,853 | 3/1969 | Earle et al. | 260/857 |
| 3,465,060 | 9/1969 | Oldham | 260/857 |
| 3,686,848 | 8/1972 | Miller et al. | 264/168 |

FOREIGN PATENT DOCUMENTS 1384121 2/1975 United Kingdom .

OTHER PUBLICATIONS

World Patents Index, Week 7541, Oct. 2, 1975, Derwent Publications Ltd.

*Primary Examiner*—Hubert C. Lorin

[57] ABSTRACT

Dyeable fibers are formed from polypropylene by blending a major portion of polypropylene with a minor portion of 1) a copolymer of nylon 6,6 and substantially equimolar amounts of hexamethylene diamine and an alkali metal salt of 5-sulfoisophthalic acid or 2) a basic reaction product of substantially equimolar amounts of N-(2-aminoethyl) piperazine and adipic acid, hexamethylene diamine and adipic acid and optionally ε-caprolactam. The blend is formed in an extruder and extruded into filaments which are quenched in air, stretched 2–4× (preferably at an elevated temperature) and bulked using a jet of heated turbulent fluid. The thusly bulked filaments are then dyed.

14 Claims, 1 Drawing Sheet

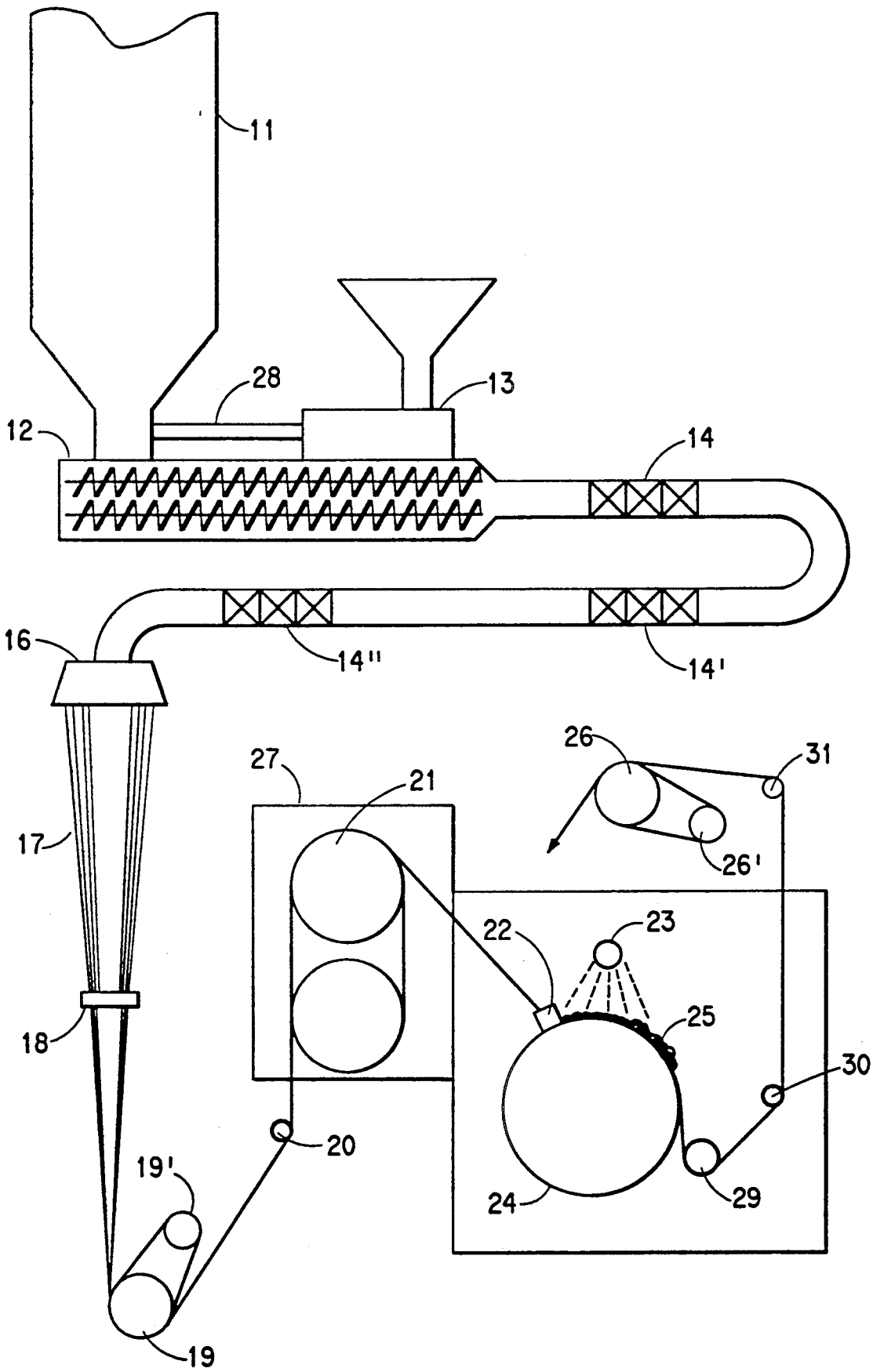
11
28
13
12
14
16
14''
14'
26
31
27
21
17
26'
22
23
25
18
30
20
19'
24
29
19

PROCESS FOR PRODUCING DYEABLE HOT-BULKED POLYPROPYLENE FIBERS MODIFIED WITH A COPOLYAMIDE

BACKGROUND OF THE INVENTION

1. Field of the Invention

This invention relates to bulked polypropylene fibers which are readily dyed by cationic, acid, or disperse dyestuffs. More specifically, it relates to bulked polypropylene fibers which have been spun from polypropylene that has been modified by blending with a dye receptor comprising 1) a copolymer of nylon 6,6 and substantially equimolar amounts of hexamethylenediamine and the alkali salt of 5-sulfoisophthalic acid or its derivatives, or 2) a basic copolyamide that is a reaction product of N-(2-aminoethyl)piperazine, adipic acid, hexamethylene diamine, and optionally, ε-caprolactam. The dye rate of the bulked fibers of the current invention is significantly improved over unbulked fibers and is increased by post dry heat treatment following bulking.

2. Prior Art

The term "bulked" is used herein to describe yarns that have been textured using a jet- or jet-screen texturing method in which a heated turbulent fluid is used to generate bulk. Breen & Lauterbach, U.S. Pat. No. 3,186,155, discloses an example of a jet-bulking process which involves exposing a bundle of filaments to a jet of rapidly moving turbulent fluid to generate bulk. Nylon 6,6,nylon 6, and polyethylene terephthalate yarns were found to exhibit faster dyeing rates when subjected to the jet-bulking process. Bulked polypropylene yarns are also disclosed, however they were formed from unmodified polymer which is not dyeable by acid or cationic dyestuffs. Miller, Clarkson, & Cesare in U.S. Pat. No. 3,686,848 disclose textured yarns spun from polypropylene modified with up to 10% poly(vinylpyridine). The effect of the texturing process on the dye rate of fibers spun from these compositions was not examined.

Polyolefins, particularly polypropylene, are used widely in the production of fibers for a variety of textile applications, including carpets. One of the major limitations of this class of polymers is that they are nonpolar and lack affinity for dye molecules, and therefore are not dyeable by conventional means. The current method of choice for commercial dyeing of polypropylene fibers is solution dyeing, a method whereby a pigment is added to the polymer melt during the spinning process. Solution-dyed polypropylene fibers have the advantages of a high degree of fastness, resistance to staining, and in many instances, lower cost than fibers made from other resins. However, solution-dyed fibers have the disadvantage that they are available from fiber producers in a limited number of colors and large inventories must be maintained, resulting in high inventory costs. Solution-dyed fibers also have the disadvantage of lack of printability, which further limits their flexibility. Polypropylene yarns which are dyeable using conventional methods will have the advantage of giving textile manufacturers increased styling flexibility over currently available solution-dyed fibers.

Suggestions have been made in the art for improving the dyeability of polypropylene by attaching dye-receptive groups to the polymer by copolymerization or grafting, or by blending with modifying polymers which contain dye-receptive groups. These methods have resulted in only moderate improvements in dyeability and have been unacceptable due to additional problems of nonuniformity, caused by incompatibility of the additives with polypropylene, or high cost.

Alliot-Lugaz & Allard, U.S. Pat. No. 3,328,484, disclose ternary polypropylene compositions for the manufacture of unbulked filaments comprising a major proportion of polypropylene and a minor proportion of a mixture of (i) a synthetic, linear polyamide and (ii) not more than an equal weight of a synthetic linear sulfonated copolyamide. These compositions are homogenous and are dyeable by basic, acidic, metallized and disperse dyes. The above-referenced patent also discloses binary compositions having an affinity for basic dyes comprising a major proportion of polypropylene and a minor proportion of a sulfonated polyamide and describes the compositions as being difficult to extrude.

Earle, et al., U.S. Pat. No. 3,433,853, disclose compositions for the manufacture of unbulked filaments comprising a major amount of a polyolefin and a minor amount of a basic polyamide which is a copolymer of an aliphatic dicarboxylic acid and a polyamine containing no more than two primary amino groups and one or more tertiary amino groups, where up to 60% of the polyamine may be replaced by a diamine. Oldham, U.S. Pat. No. 3,465,060, discloses compositions for the manufacture of unbulked filaments comprising a major proportion of a polyolefin containing a minor amount of a basic polyamide, where the polyamide is the reaction product of one or more dicarboxylic acids with a polyamine having at least 3 amino groups, at least one of which is secondary or tertiary, and a lactam containing 6–12 carbon atoms. Part of the polyamine may be replaced by diamine. These compositions provide olefin polymers with improved acid dyeability.

SUMMARY OF THE INVENTION

It has been found that the dyeability of fibers comprised of certain of the compositions described above can be dramatically improved by subjecting the filaments to a jet-bulking process in which a heated fluid, such as air, is used to bulk the filaments. Further increases in dye rate may be achieved by post-heat treatment of the yarns. This makes it possible to use less of the dye-receptive additive than would otherwise be necessary to obtain acceptable dye rates. It has also been found that nonaqueous finishes must be used in the spinning process to eliminate deposits which interrupt spinning continuity.

BRIEF DESCRIPTION OF THE DRAWING

The drawing is a schematic diagram of the bulking process used herein for the preparation of bulked polypropylene yarns.

DETAILED DESCRIPTION

The dyeability of polypropylene fibers by cationic dyestuffs can be improved over the prior art by blending polypropylene with a copolymer of nylon 6,6 and a cationic dye modifier such as the dimethyl ester of an alkali salt of 5-sulfoisophthalic acid or its derivatives, including the corresponding esters or acid halides, reacted with a substantially equimolar amount of hexamethylene diamine and bulking the fibers using a jet-bulking process. Preferably, the additive copolymer is prepared using 7–25 wt % of the dimethyl ester of sodium 5-sulfoisophthalic acid based on the final copolymer weight, and more preferably, 10–25 wt %.

The dyeability of polypropylene fibers by acid dyestuffs can be similarly improved over the prior art by blending the polypropylene with a basic polyamide which is the reaction product of N-(2-aminoethyl)piperazine (2PiP), a substantially equimolar amount of adipic acid, (N-(2-aminoethyl) piperazinium adipate salt), hexamethylene diamine and a substantially equimolar amount of adipic acid (hexamethylene diammonium adipate salt), and optionally ε-caprolactam and spinning fibers using a jet-bulking process. The resulting random copolymer is referred to herein as 2PiP-6/6,6/6. The preferred compositions are 30–50 wt % 2PiP-6/40–60 wt % nylon 6,6/0–39 wt % nylon 6.

The polyamide copolymers used as the dye-receptive additives are prepared using methods well known in the art. They may generally be prepared by heating the reactants together, preferably as aqueous solutions in an autoclave at temperatures between about 200° and 290° C. and a pressure of approximately 250 psi ($17.2\times10^5$Pa), to obtain a random copolymer. Because of the water sensitivity of the 2PiP-6/66/6 polymers, it is necessary to protect them from exposure to moisture after polymerization. It is important that the polyamide copolymers be completely dried to remove all traces of water before blending with polypropylene, otherwise problems with spin deposits can occur during fiber manufacture. Blending of the polypropylene with the polyamide copolymers can be achieved using conventional means which provide intimate mixing of the two components. For example, mixing may be achieved at the feed section of a screw extruder, preferably a twin screw, by melting and mixing the blend at temperatures between 230°–265° C. A series of static mixers in the transfer line may be used to improve mixing. The polypropylene polymers used in preparing the blends preferably have melt flow indexes of between about 4 and 45. The copolymers may be blended with the polypropylene over a wide range of compositions. Amounts of copolymer ranging from 4–15% and preferably 4–10%, have been found to be useful for optimum dyeing characteristics.

DETAILED DESCRIPTION OF THE DRAWING

The spinning and bulking process used for the examples described herein is outlined in the drawing. A supply hopper 11 supplies polypropylene flake into the throat of a twin-screw extruder 12. The polypropylene is blended with about 4–15% of the additive copolymer flake which is fed at a controlled rate from feeder 13 into a piping 28 connected to the throat of the twin-screw extruder 12. The extruder provides shear mixing of the two flake components as they melt. The polymer blend is mixed further in the transfer line 15 by static mixers 14, 14', and 14'', and extruded through spinneret 16 at temperatures of from about 230°–265° C. The molten fibers are rapidly quenched at 17 using cross-flow air (4°–21° C.), coated with a nonaqueous spin finish using applicator 18, and wrapped around a motor-driven feed roll 19 and its associated separator roll 19'. The yarn is fed over pin 20, and then wrapped around draw rolls 21 which are normally heated to 120°–145° C. enclosed in a hot chest 27 and stretched to from two to four times its original length before entering the bulking jet 22. If an aqueous finish is applied at 18, deposits on the hot-chest rolls 21 interfere with the spinning process. The yarn is crimped in jet 22 using air which is normally heated to 80° to 160° C. preferably 105° to 150° C., and exits the jet to impinge upon a rotating drum 24 which has a perforated surface on which the yarn cools in the form of a bulky caterpillar 25 to set the crimp wherein the fiber has a length 0.5 to 0.9 times the length of the fiber prior to crimping. Cooling of the yarn is facilitated by using a water mist quench 23. From the drum, the threadline passes over pins 29, 30 and 31 to motor-driven takeup roll 26 and its associated separator roll 26'. The speed of takeup roll 26 is adjusted to maintain the caterpillar 25 at the desired length. The yarn then proceeds to a winder where it is wound in the desired package configuration.

The fibers can be dyed as yarns or shaped articles using conventional cationic or acid dyes, depending on the nature of the dye-receptive additive. Additional heat treatment prior to dyeing can improve the dyeability significantly.

EXAMPLES

Dyeing Procedure

The following procedure was used to evaluate the dyeability of the acid-dyeable polypropylene yarns: One gram of fiber is dyed in a bath containing 5 ml Tectilon Blue 2GA 200% (C.I. Acid Blue No. 40) solution (0.0025 g/ml), 2 ml $NaH_2PO_4$ solution (0.01 g/ml), 5 ml Sandopan DTC100M surface-active agent solution (manufactured by Sandoz, Inc., Hanover, N.J. 07936) (0.01 g/ml), and 13 g distilled water, to provide a dye concentration of 500 ppm. The bath is adjusted to a pH of 3 with a solution of 2g $H_3PO_4$ in 100 ml water (approximately 5 drops). The dye bath is refluxed in a 50 ml 3-necked flask and the fiber added. Refluxing is continued for 10 minutes, after which the bath is immersed in a room-temperature water bath. A 2 ml aliquot of the cooled dyebath is diluted to 25 ml in a volumetric flask and the concentration of the dye measured with a Cole Parmer Model 5965-50 Digital Colorimeter at a wavelength of 660 millimicrons in conjunction with a calibration curve generated using 10–40 ppm dye solutions. The concentration of the dye remaining in the dyebath was calculated and subtracted from the initial concentration (500 ppm) to give X, the amount of dye removed from the dyebath by the fiber. The dye exhaust is calculated using the equation: % DYE EXHAUST $=(X/500)\times100$.

The wet fiber from the dyebath is rinsed in distilled water and padded with paper towels to a weight of approximately 1.5 g. This fiber is then scoured at 50° C. for 5 min in a solution of 1 ml Duponol RA wetting agent (manufactured by E. I. du Pont de Nemours and Company, Wilmington, Del.) solution (1g/100 ml) and 40 ml water. This bath is transferred quantitatively to a 100 ml volumetric flask, fiber washings added, and the volume brought to 100 ml with distilled water. The concentration of the dye in the diluted scour bath is determined with the colorimeter, and converted back to the concentration that would have been present in the 25 ml dye bath. This concentration added to the exhaust dyebath concentration and subtracted from the initial 500 ppm original dyebath concentration quantifies the amount of the dye which remains on the fiber (Y). The percent dye-on-fiber (% DOF) is calculated using the equation:

$$\%\ DOF=(Y/500)\times100.$$

The dyeability of the cationic-dyeable polypropylene fibers (Examples 1–3) was measured using a similar procedure as that described above. The dyebath used consisted of 5 ml of a solution of Sevron Blue ER 200% (C.I. Basic Blue No. 77) dye (0.001 g/ml), 2 ml $NaH_2PO_4$ solution (0.01 g/ml), 1 ml Merpol SH (manufactured by E. I. du Pont de Nemours & Co., Wilmington, Del.) (0.01 g/ml), and 17 g water (Dyebath pH=4.3). The dyebath concentration was measured using a spectrophotometer setting of 530 millimicrons.

EXAMPLES 1-3

A modified nylon copolymer was prepared by mixing 33.6 wt % of an aqueous solution containing 33.55 wt % dimethyl sodium 5-sulfoisophthalate, 10.8 wt % hexamethylene diamine, and 0.475 wt % ammonium hydroxide with 63.9 wt % of an aqueous solution containing 51.5 wt % nylon 6,6 salt in an autoclave. Various conventional antioxidants and UV stabilizers were added to make up the remainder and the mixture was polymerized at 270° C. and bleeding off steam at 250 psi ($17.2\times10^5$Pa) to obtain a random copolymer containing approximately 25 wt % of the sodium 5-sulfoisophthalate based on starting diester. The copolymer was cut into ¼" (0.635cm) flake and dried to remove all traces of water.

Polypropylene resin having a melt flow rate of 15 (Shell Co.) (polymer code DX5A84U, Shell Co., One Shell Plaza, Houston, Tx.) was blended with about 5% by weight of the cationic modified copolymer in a twin-screw extruder manufactured by Berstorff Co. The additive copolymer was fed into the throat of the twin-screw extruder with a volumetric feeder (manufactured by Vibra Screw Inc., Totowa, N.J.) at a controlled feed rate to yield the desired level of additive. The polymer blend was mixed further in the transferline by static mixers and extruded at 255° C. through a 136-hole trilobal spinneret which was divided into two 68 filament segments into a quench chimney where cooling air at 10° C. was blown past the filaments at 500 $ft^3$/min (0.236$m^3$/sec). The filaments were pulled by a feed roll rotating at a surface speed of 543 yd/min (497 m/min) through the quench zone and then were coated with a nonaqueous finish using an ultrasonic finish applicator similar to that described in Strohmaier, U.S. Pat. No. 4,431,684. The finish was a blend of 25 parts Kessco PEG-200 dilaurate (Stepan Co., Northfield, Ill. 60093), 15 parts Emery 6724 (Emery Industries, Inc., Mauldin, S. C. 29962), and 60 parts Nopco 2152 (Diamond Shamrock, Cleveland, Oh. 44114). The yarn was drawn at a 2.9 draw ratio using draw rolls which were enclosed in a hot chest, and then forwarded into a dual-impingement bulking jet similar to that described in Coon, U.S. Pat. No. 3,525,134 to form two 1000 denier (15 dpf) yarns. The fibers of Example 1 were processed using unheated hot-chest rolls and with unheated air in the bulking jet. As can be seen from Table I, the dye rate shown by these yarns is not as high as when heated hot chest rolls and heated air in the bulking jet are used as in otherwise comparable Examples 2 and 3.

In Example 2, the fibers were heated to 130° C. on a set of hot-chest rolls prior to being crimped in the bulking jet using air at 145° C.

In Example 3, a 1 g sample of the yarn from Example 2 was placed between two heated (138° C.) metal plates with just enough pressure to ensure contact for 10 sec.

EXAMPLES 4-6

A 2PiP-6/6,6/6 copolymer having the composition 31 wt % 2PiP-6/48 wt % 6,6/21 wt % 6 was prepared by mixing 17.7 kg of a 50 wt % solution of nylon 6,6 salt, 3,267 g ε-caprolactam, 1.3 gm Dow Corning Antifoam B 10% emulsion (Dow Corning Corp., Hidland, Mich. 48640), 147 g of a solution containing 21.5 wt % sodium phenyl phosphinate (an antioxidant), 3,027 g adipic acid, and 2,676 g N-(2-aminoethyl)piperazine in an autoclave and flushing with nitrogen. The mixture was heated to 220° C. while bleeding off steam at 250 psi ($17.2\times10^5$ Pa), and held for 2 hrs. The temperature was then increased to 260° C. and the mixture held at temperature for 1 hr. The pressure was reduced to atm ($1\times10^5$ Pa) over a period of 1 hr and the polymer extruded onto dry ice. The polymer was then cooled in liquid nitrogen and ground in a Thomas Cutter (Arthur A. Thomas Co., Philadelphia, Pa, Cat. #3379 K25) using a ⅛ in ($3.2\times10^{-3}$ m) screen.

Polypropylene was blended with approximately 5 wt % of the basic polyamide copolymer in the feed section of a screw extruder, using the same process and conditions described in Examples 1-3 above. The fibers of Example 4 were processed using unheated hot-chest rolls and unheated air in the bulking jet and the dye rate of the yarn is lower than in otherwise comparable Examples 5 and 6 where heated hot chest rolls and heated air in the bulking jet were used.

In Example 5, the yarn was heated to 130° C. on a set of hot-chest rolls prior to being crimped using a dual-impingement jet and air at 130° C.

Example 6 yarn was prepared by post heat treatment of the fibers of Example 5 at 138° C., in the same manner as described in Example 3 above.

The fibers of Examples 1-6 were dyed according to the dyeing procedures described above. The % DYE EXHAUST and % DOF are listed in Table I below:

TABLE I

| EXAMPLE | % DYE EXHAUST | % DOF |
|---|---|---|
| 1 | 73 | 69 |
| 2 | 90 | 87 |
| 3 | 96 | 95 |
| 4 | 65 | 49 |
| 5 | 81 | 66 |
| 6 | 98 | 89 |

These examples demonstrate the significant increase in the rate of dye uptake which occurs as a result of the bulking process. An additional increase in dye rate is achieved by post heat treatment of the fibers. By increasing the level of the dye-receptive additive copolymers, dye exhausts of 100% can be achieved.

EXAMPLE 7

A copolymer additive having the composition 2PiP-6/6,6 (50/50 wt %) was prepared using a procedure similar to that in Example 4. The copolymer was fed to the extruder and blended with polypropylene and was spun and processed similar to the yarn in Example 5. Nitrogen analysis showed that the yarn contained 6.6 wt % of the copolymer additive. Test dyeing with Tectilon Blue (C.I. Acid Blue No.40) gave 100% DYE EXHAUST and 96% DOF after scouring.

EXAMPLE 8

A copolymer additive with the same composition as in Example 4 was prepared without the addition of sodium phenyl phosphinate. It was blended and spun with polypropylene as described in Example 7. The content of additive as evaluated by nitrogen analysis of the spun yarn was 7.8 wt %. Evaluation of the dyeability of the bulked yarn gave a dye exhaust of 100% and % DOF=98%.

EXAMPLE 9

The proportion of additive in Example 8 was increased to 9.4 wt% and the dye evaluation of the bulked yarn gave a % DYE EXHAUST of 100% and % DOF=100%.

EXAMPLES 10-12

In Example 10, polypropylene resin was blended with about 10 wt % of the modified copolymer as described in Example 1, except that the filaments were spun at 255° C., the draw rolls were heated to 130° C., air at 140° C. was used in the bulking jet, and an aqueous finish (90% water 10% of lubricant described in Example 1) was applied via a rotating ceramic roll applicator. The spinning process deteriorated after about 30 minutes due to heavy deposits on the draw rolls and bulking jet. This required shutting down the machine for cleaning.

The yarn of Example 11 was prepared in a process identical to that used in Example 10, except that the nonaqueous finish of Example 1 was used. Spinnability was excellent with no deposits observed on the draw rolls or bulking jet during 5 hours of spinning.

In Example 12, the yarn of Example 11 was heated at 138° C. for 10 sec in the same manner as described for Example 3 above. Dyeability test results are given in Table II below.

TABLE II

| EXAMPLE | % DYE EXHAUST | % DOF |
|---|---|---|
| 11 | 94 | 93 |
| 12 | 99 | 99 |

EXAMPLES 13-14

A 2PiP-6/6,6 copolymer having a composition of 40 wt % 2PiP-6 and 60 wt % nylon 6,6 was prepared using the same procedure as described in Examples 4-6 except that 18,359 g of 51.5% nylon 6,6 salt, 3,322 g adipic acid, and 2,927 g N-(2-aminoethyl)piperazine were used with 95 g of the 21.5% sodium phenyl phosphinate solution as well as 2.7 g of cupric acetate monohydrate and 19 g of potassium iodide. Approximately 10 wt. % of this copolymer was blended with approximately 90 wt. % of the polypropylene and extruded in the process described in Example 2 except the chest roll temperature was set at 135° C. and the bulking jet air temperature was set at 140° C.

In Example 14, the yarn of Example 13 was heated to 138° C. for 10 seconds between heated metal plates as described in Example 3 above.

The dyeability test results are summarized in Table III below:

TABLE III

| EXAMPLE | % DYE EXHAUST | % DOF |
|---|---|---|
| 13 | 85 | 54 |
| 14 | 99 | 86 |

EXAMPLE 15

The yarn samples of Examples 11 and 13 were ply twisted to form a 2,000 denier yarn. The test yarn was tufted into a 28 oz/yd$^2$ (0.94 Kg/m$^2$), ¼ inch pile (0.635 cm) height loop pile carpet. Samples of this carpet (12 inch (30.5 cm)×30 inch (76 cm)) were heated in an oven at 80°, 100°, and 120° C. for 10 minutes and then dyed in a dye bath containing 0.5% Merpacyl Blue 2GA acid dye (C.I. Acid Blue No. 40) and 0.5% Sevron Red L cationic dye (C.I. Basic Red No. 17) at various pH's. The dye bath temperature was 210° F. (99° C.)and dyeing time was approximately one hour. The dye depth based on visual ratings are summarized below:

| OVEN TEMP. (°C.) | pH | COLOR DEPTH |
|---|---|---|
| NO HEAT | 3 | LIGHT RED/LIGHT BLUE |
| 80 | 3 | MEDIUM RED/MEDIUM BLUE |
| 100 | 3 | DARK RED/DARK BLUE |
| 120 | 3 | DARK RED/DARK BLUE |
| NO HEAT | 6 | LIGHT ORANGE/FAINT BLUE |
| 80 | 6 | DARK ORANGE/FAINT BLUE |
| 100 | 6 | DARK ORANGE/FAINT BLUE |
| 120 | 6 | DARK ORANGE/FAINT BLUE |

EXAMPLE 16

Approximately 13 wt % of the modified copolymer described in Example 1 was blended with polypropylene and extruded into two 1000 denier (15 dpf) BCF yarns using the process described in Example 11, except that the air used in the bulking jet was 130 degrees C. The yarn was tufted into a 25.5 oz/sq yd (0.865 Kg/m$^2$) loop pile carpet with ¼" (6.35×10$^3$m) pile height. The carpet was cut into three sections (36 inches (0.9 m)×30 inches(0.76 m)). One piece received no further heat treatment, a second piece was heated in an oven at 140° C. for 10 min, and the third piece was treated in an autoclave with 132° C. saturated steam for one hour. All three samples were scoured with warm water at 71° C. and beck dyed in a solution at pH 6 containing 1.0 wt % Sevron Blue ER cationic dye (C.I. Basic Blue No. 77) at 210° F. (99° C.) for one hour. The dye depth was judged as follows oven dry heat > no heat treatment > autoclave steam heat treatment. This indicates that post-heat treatment with dry heat is preferred to steam heat treatment.

We claim:

1. A process for producing dyeable filaments formed of a blend of 85 to 96 weight percent isotactic polypropylene having a melt flow index of from 4 to 45 and 4 to 15 weight percent of either a random copolymer of hexamethylene adipamide and a substantially equimolar mixture of hexamethylene diamine and 7 to 25 weight percent based on final copolymer weight of an alkali metal salt of 5-sulfoisophthalic acid or a derivative thereof, or a basic random, copolyamide which is the reaction product of 30 to 50 weight percent of N-(2-aminoethyl) piperazinium adipamide, from 40 to 60 weight percent hexamethylene adipamide and up to 30 weight percent ε-caprolactam comprising melt extruding a filament of such blend, stretching said filament from 2 to 4 times its original length, bulking the thus formed stretched filament using a rapidly moving heated fluid at a temperature of from 105° to 150° C. to form a bulked filament and applying a dye solution to said stretched bulked filament to produce a dyed filament.

2. The process of claim 1 wherein the filament is a blend of polypropylene and a random copolymer of hexamethylene adipamide and substantially equimolar amounts of hexamethylene diamine and an alkali metal salt of 5-sulfoisophthalic acid or a derivative thereof.

3. The process of claim 2 wherein the random copolymer contains from 10 to 25 weight percent of the alkali metal salt of 5-sulfoisophthalic acid or a derivative thereof.

4. The process of claim 3 wherein the filament is stretched using draw roll heated from 120° to 145° C.

5. The process of claim 4 wherein the fluid used to bulk the filaments is air.

6. The process of claim 5 wherein the filament is dyed in a dyebath.

7. The process of claim 6 wherein the blend forming the filament contains from 90 to 96 weight percent polypropylene and from 4 to 10 weight percent of the random copolymer.

8. The process of claim 7 wherein the dye is a cationic dye.

9. The process of claim 1 wherein the filament is a blend of polypropylene and a basic random copolyamide which is the reaction product of N-(2-aminoethyl) piperazinium adipamide, hexamethylene adipamide and optionally ϵ-caprolactam.

10. The process of claim 9 wherein the filament is stretched using draw rolls heated to from 120° to 145° C.

11. The process of claim 10 wherein the fluid used to bulk the filaments is air.

12. The process of claim 11 wherein the filament is dyed in a dyebath.

13. The process of claim 12 wherein the blend forming the filament contains from 4 to 10 weight percent basic random copolyamide.

14. The process of claim 13 wherein the dye is an acid dye.

* * * * *